US005535567A

United States Patent [19]

Cahoon

[11] Patent Number: 5,535,567

[45] Date of Patent: Jul. 16, 1996

[54] STANDING SEAM ROOFING PANEL

[75] Inventor: Michael P. Cahoon, Brenham, Tex.

[73] Assignee: Razor Enterprises, Inc., Brenham, Tex.

[21] Appl. No.: 320,890

[22] Filed: Oct. 5, 1994

[51] Int. Cl.[6] ..... E04D 3/363

[52] U.S. Cl. ..... 52/520; 52/531; 52/588.1; 52/533; 52/536; 52/546

[58] Field of Search ..... 52/519–522, 529, 52/533, 536, 537, 546, 588.1, 478, 543, 531

[56] References Cited

U.S. PATENT DOCUMENTS

| | | | |
|---|---|---|---|
| 312,658 | 2/1885 | Sagendorph | 52/520 |
| 362,118 | 5/1887 | Sagendorf | 52/519 X |
| 372,589 | 11/1887 | Andrews . | |
| 396,605 | 1/1889 | Sagendorph . | |
| 403,899 | 5/1889 | Abrahams . | |
| 453,707 | 6/1891 | Smyth . | |
| 614,294 | 11/1898 | Demore . | |
| 1,073,485 | 9/1913 | Hames . | |
| 1,137,746 | 5/1915 | Edwards . | |
| 1,292,960 | 1/1919 | Owens . | |
| 2,159,136 | 5/1939 | Delk | 52/543 X |
| 2,399,891 | 5/1946 | Routt . | |
| 3,135,070 | 6/1964 | Waring et al. . | |
| 3,388,518 | 6/1968 | Scott | 52/520 X |
| 3,394,524 | 7/1968 | Howarth | 52/529 X |
| 3,399,915 | 9/1968 | Stanzak . | |
| 3,473,274 | 10/1969 | Godes | 52/543 X |
| 3,495,363 | 2/1970 | Johnson . | |
| 3,958,387 | 5/1976 | Kandabashi . | |
| 4,091,588 | 5/1978 | Heirich . | |
| 4,099,356 | 7/1978 | Graham . | |
| 4,102,105 | 7/1978 | Taylor et al. . | |
| 4,106,250 | 8/1978 | Cummings et al. . | |
| 4,109,437 | 8/1978 | Player et al. . | |
| 4,217,741 | 8/1980 | Cole | 52/520 |
| 4,266,385 | 5/1981 | Oehlert . | |
| 4,435,938 | 3/1984 | Rutkowski et al. | 52/521 |
| 4,495,743 | 1/1985 | Ellison . | |
| 4,570,404 | 2/1986 | Knudson | 52/520 |
| 4,759,166 | 7/1988 | Hill, Sr. . | |
| 4,878,331 | 11/1989 | Taylor . | |
| 4,926,608 | 5/1990 | Beauregard | 52/542 X |
| 5,038,543 | 8/1991 | Neyer . | |
| 5,140,793 | 8/1992 | Knudson . | |
| 5,241,785 | 9/1993 | Meyer | 52/478 X |
| 5,247,772 | 9/1993 | Greenberg . | |

*Primary Examiner*—Robert J. Canfield

*Attorney, Agent, or Firm*—Pravel, Hewitt, Kimball & Krieger

[57] ABSTRACT

An interlocking roofing panel is disclosed. The panel has longitudinal edges and large and small dikes extending along these edges. These dikes interlock to form a standing seam. Upon installation, the top wall of the small dike is sufficiently spaced below the top wall of the first dike of an overlapping longitudinally adjacent panel, defining an "upper gap," to interrupt movement of water between the dikes. Also, the small dike features a concave portion which opens towards the primary panel portion and the first dike has a linking portion, so that the linking portion extends into the concave portion while being sufficiently spaced within the concave portion, defining a "lower gap," that, during installation, upward movement of the first dike relative to the small dike is permitted.

21 Claims, 3 Drawing Sheets

FIG. 1
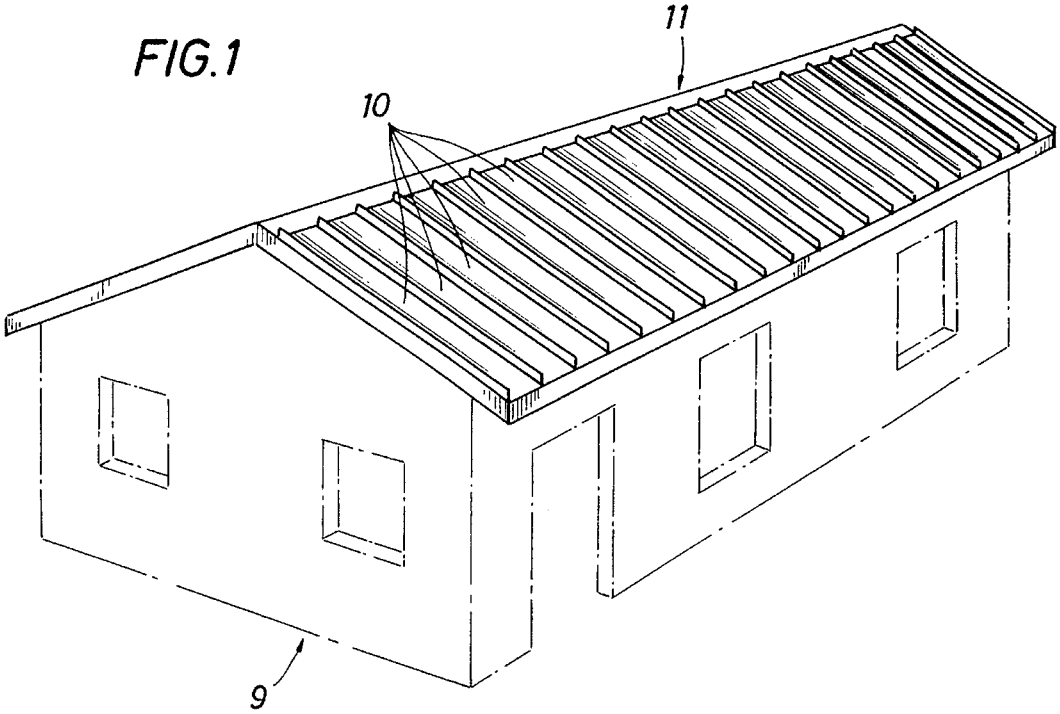
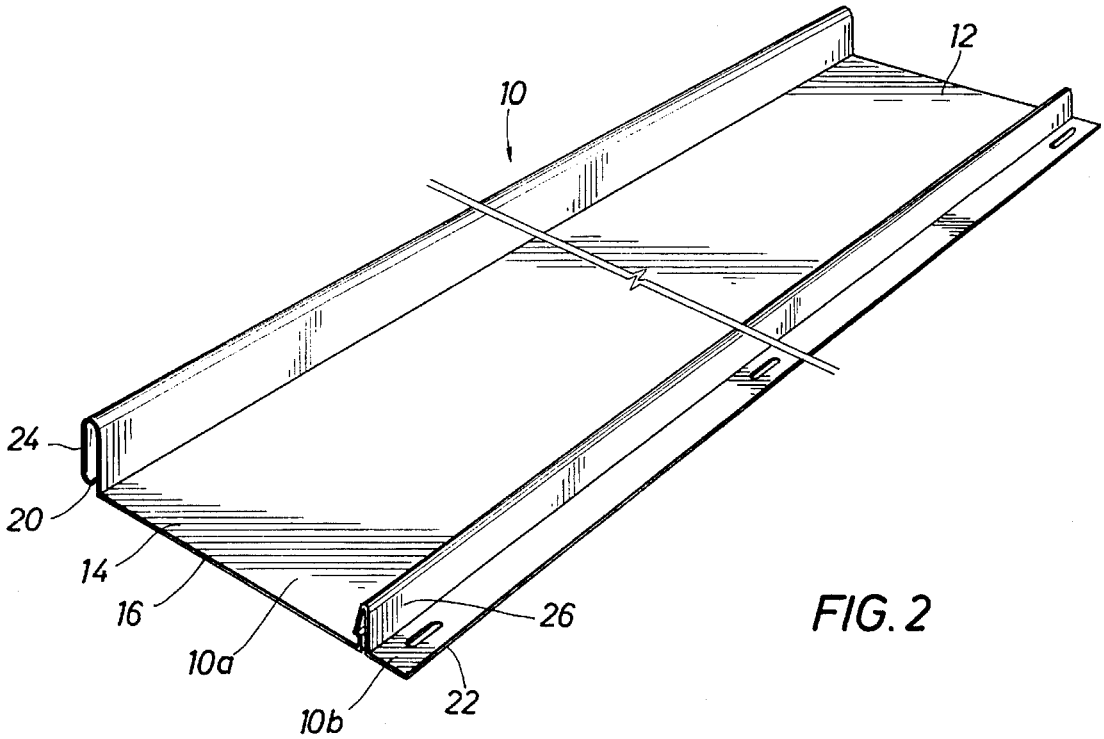
FIG. 2

STANDING SEAM ROOFING PANEL

BACKGROUND OF THE INVENTION

1. Field of the Invention

This invention relates to roofing panels. More particularly, this invention relates to interlocking side-by-side roofing panels.

2. Description of the Related Art

The roof of a structure can be protected by a wide variety of roofing materials such as asphalt, slate, or metal. It is also known that the roof of a structure may be protected by a series of side-by-side interlocking roofing panels.

However, problems arise in trying to secure such panels to a roof so that they survive substantial wind conditions and the capillary action of water (and the problems it causes to the underlying roof structure). Other problems in the art include economically increasing the strength of the interlock while decreasing the amount of time and difficulty associated with installing such panels. This list is by no means exhaustive.

Some of the solutions suggested for solving these problems include: the use of tightly engaging seams (see, e.g., U.S. Pat. No. 5,247,772); the use of slip plates (see, e.g., U.S. Pat. No. 4,878,331) and clip connectors or clips (see, e.g., U.S. Pat. No. 4,102,105 and U.S. Pat. No. 4,099,356); the use of sealants (see, e.g., U.S. Pat. No. 4,106,250); and the use of novel geometries for defining the seam or interlock between two panels (see, e.g., U.S. Pat. No. 4,759,166 (return bend recess) and U.S. Pat. No. 4,106,250 (double-wall skirt member)).

The present invention is effective in addressing the prior art problems disclosed above. In addition, it is effective in addressing a problem which has received little, if any, attention to date. Specifically, the panel disclosed herein is effective in providing a sound, integral, leak-resistant roofing structure over nonplanar roofs.

Thus, it is an object of the present invention to provide a roofing panel which is not only effective in covering well-constructed roofing structures but is effective in protecting non-planar surfaces.

SUMMARY OF THE INVENTION

The present invention is an interlockingly joinable panel with longitudinally-adjacent panels of the same type. Each roofing panel comprises a first and a second longitudinal edge, a large dike extending along the first longitudinal edge and a small dike extending along the second longitudinal edge, a primary panel portion between the dikes, and a secondary panel portion between the small dike and the second longitudinal edge.

The small dike is sized to be received within the downwardly opening channel defined by the large dike of a longitudinally overlapping panel. When the large dike is "snapped" into place over the small dike, a standing seam is formed.

Upon installation, the top wall of the small dike is spaced sufficiently below the top wall of the large dike of an overlapping longitudinally adjacent panel that an upper gap is defined. Among other things, this upper gap interrupts movement of water between the dikes.

The standing seam defines a lower gap as well. The descending wall of the small dike defines a horizontally opening channel which opens towards the primary panel portion. The large dike has a linking portion that extends into the channel and is sufficiently spaced within the channel that a lower gap is defined. During installation, this lower gap permits upward movement of the large dike relative to the small dike. This is particularly significant in the case of nonplanar roof surfaces.

A number of fastening arrangements are also disclosed which are effective for securing the panels to the roof.

BRIEF DESCRIPTION OF THE DRAWINGS

A better understanding of the present invention can be obtained when the following detailed description of the preferred embodiment is considered in conjunction with the following drawings, in which:

FIG. 1 is a perspective view of a building illustrating a plurality of the standing seam roofing panels of the present invention;

FIG. 2 is a perspective view of a roofing panel in accordance with the present invention;

DETAILED DESCRIPTION OF THE PREFERRED EMBODIMENT

Figure 3:
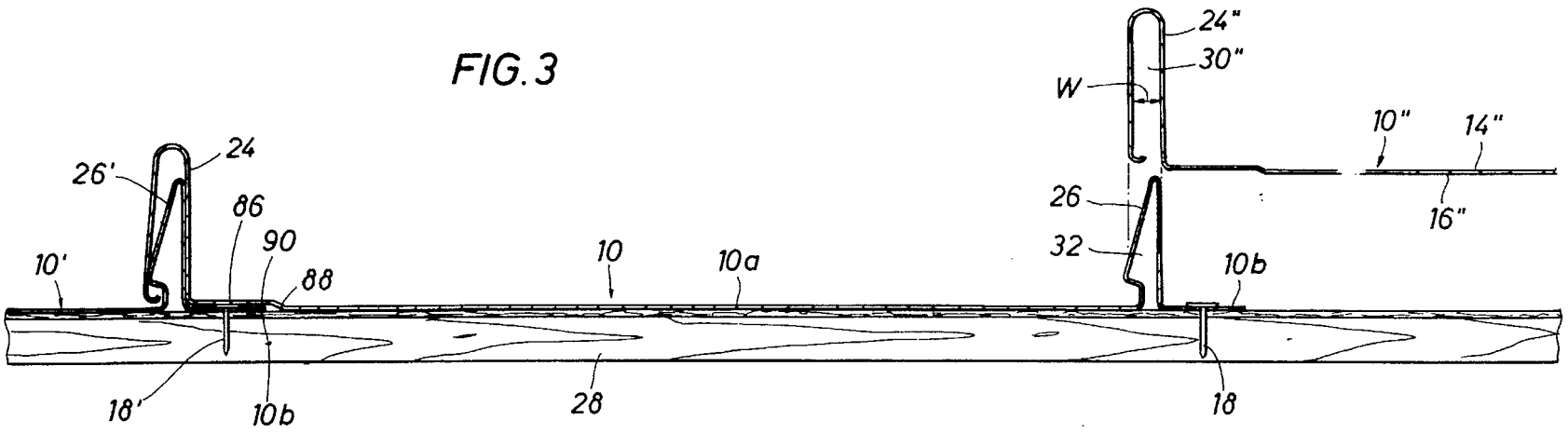
FIG. 3 is a cross-sectional view of a roofing panel of the present invention.

Referring to FIGS. 1–2, FIG. 1 shows a building 9 having a roof 11 made up of standing seam roofing panels 10. Although FIG. 1 depicts a single panel spanning the length from the ridgeline to the eve of the roof, in many cases it is likely that several horizontal rows of similarly aligned panels would be used to completely span the slope of the roof. Referring to FIG. 2, each panel 10 is generally rectangular in shape and made of a rigid sheet of metal 12, preferably steel of 28 to 20 gauge metal, still more preferably steel of 26 to 24 gauge metal. Although steel of the stated gauge is preferred, it will be understood by those skilled in the art that other metals (e.g., aluminum, copper) and gauges may be employed. Each panel 10 has an upper surface 14 and a lower surface 16. A large (or upper) dike 24 projects upwardly from upper surface 14 along one longitudinal edge 20, and a small (or lower) dike 26 projects upwardly from the upper surface 14 along an opposing longitudinal edge 22. The portion of the panel between dikes 24 and 26 is termed the primary panel portion 10*a*; the remaining portion of the panel between the small dike and its longitudinal edge is called the secondary panel portion 10*b*.

Referring now to FIG. 3, portions of three panels (10', 10, 10") are shown. In FIG. 3, each of the panels is secured to a roof from left to right (although the panels may be installed in mirror-image fashion just as well from right to left if the orientation of each panel is reversed). As shown, the left-hand panel includes primed reference numerals (e.g., 10'); the middle panel includes non-primed reference numerals (e.g., 10); and the right-hand panel includes double-primed reference numerals (e.g., 10").

Referring still to FIG. 3, small dike 26' of left-hand panel 10' is visible; this portion of the left-hand panel has been secured to a roof board 28 by means of fasteners 18'. The next panel (middle panel 10) is secured in place in two ways. First, the large dike 24 is snapped into an interlocking relationship with small dike 26' of left-hand panel 10', forming a standing seam (shown in detail in FIG. 4). Second, as in the case of the left-hand panel, the secondary panel portion **10*b* is secured to the roof board 28 by means of nails 18. Finally, note in FIG. 3 the large dike 24" of the right-hand panel 10" which is about to be snapped into position; like middle panel 10, panel 10 will be fully secured when fasteners 18" are applied to its secondary panel portion 10*b***" (not shown).

Figure 4:
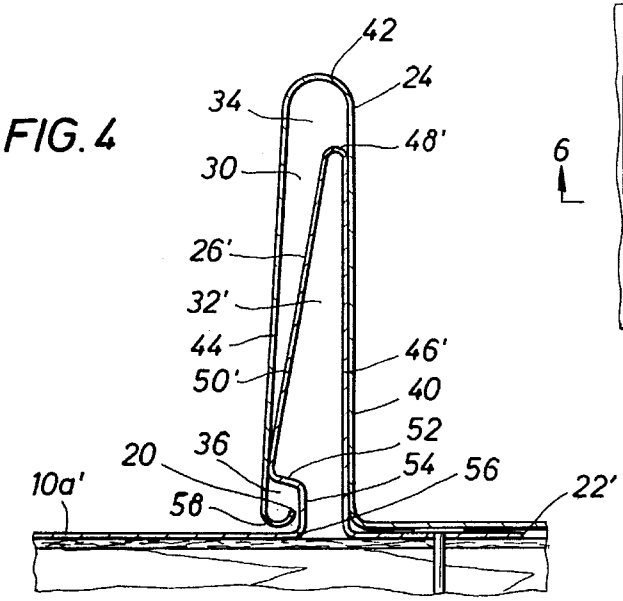
FIG. 4 is a detail cross-sectional view of the standing seam of the present invention.

Referring now to FIG. 4, the standing seam of the present invention is shown. Large dike 24 projects upwardly along the length of first longitudinal edge 20, and a small dike 26' projects upwardly along the length of an opposing second longitudinal edge 22'. Large dike 24 includes an ascending wall 40, a top wall 42, and a descending wall 44; similarly small dike 26' includes an ascending wall 46', a top wall 48', and a descending wall 50'.

The interior of large dike 24 defines a downwardly opening channel 30; likewise, the interior of small dike 26' forms a downwardly opening channel 32'. Small dike 26' has been sized so as to be received within channel 30. Furthermore, small dike 26' and the large dike 24 have been sized in such a way (note the relative lengths of their ascending walls) that, upon installation, the top wall 48' of small dike 26' is sufficiently spaced below the top wall 42 of large dike 24 that an upper gap 34 is formed. Among other things, upper gap 34 serves to interrupt potential capillary movement of water between the dikes.

The engagement of small dike 26' with large dike 24 also serves to define a lower gap 36. The descending wall 50' of the small dike defines a horizontally opening channel (also termed a concave portion or linking channel) described by its upper wall 52, its middle wall 54, and its lower wall 56. This horizontally opening channel of the small dike opens towards the primary panel portion **10*a*. The large dike has a linking portion 58 extending from the bottom of the descending wall 44 of the large dike. In FIG. 4, linking portion 58 is a hook which extends into the horizontally opening channel defined by the small dike and is sufficiently spaced below the upper wall 52 of the horizontally opening channel to define lower gap 36. Lower gap 36 ensures that upward movement of large dike 24 relative to the small dike 26'** is permitted during installation.

Lower gap 36 also serves a number of other purposes. For example, it permits the installation of a panel 10 over nonplanar surfaces. Lower gap 36 also permits the removal of panels 10 following installation without significant damage. Finally, lower gap 36 relieves the effects of thermal expansion and contraction which have been problematic for roofing structures featuring tightly fitting panels.

Referring back to FIG. 3, large dike 24" and small dike 26 are arranged so that the maximum width of downwardly opening channel 32 of small dike 26 (sometimes termed the "bridge of the nose") is slightly greater than the maximum width W of the downwardly opening channel 30" of large dike 24". This maximizes the stress between the large and small dikes which acts in a direction generally normal to the areas of contact between the dikes (the ascending and descending walls of the dikes). This provides frictional force which secures the panel in place once installed.

Figure 6:
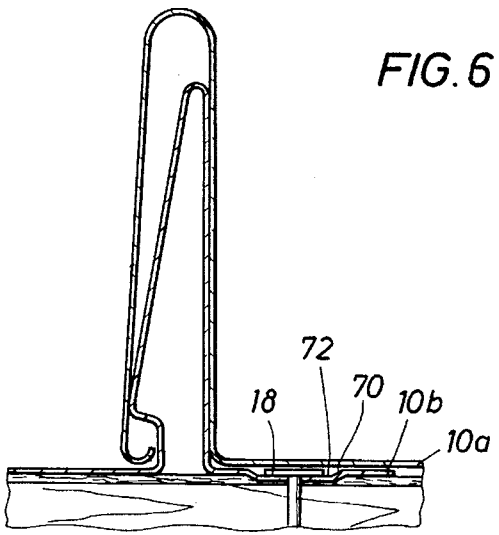
FIG. 6 is a detail cross-sectional view of as taken along line 6—6 of FIG. 5.
Figure 5:
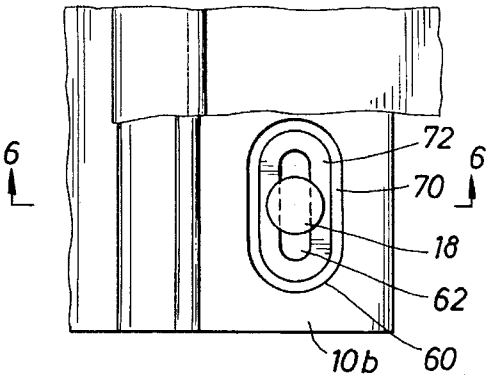
FIG. 5 is a detail top cut away view of the present invention.

Referring now to FIGS. 5 and 6, an alternative fastening arrangement is shown. Fasteners 18 secure panel portion **10*b* to the roof board 28. Panel portion 10*b* in FIG. 6 includes a recessed section 60. This recessed section is adapted to receive fasteners 18 for securing the panel to the roof board and serves to prevent the head of the fasteners from indenting the top portion 10*a*** of the adjacent panel, a problem commonly referred to as "read through."

Recessed section 60 could take any number of shapes. Generally, local recessed section 60 includes a descending wall 70 and a bottom wall 72. The recessed section 60 includes a slot 62 for receipt of fastener 18. Slots 62 serve to accommodate and relieve thermal expansion and contraction of adjacent panels which occurs due to changes in temperature.

Figure 7:
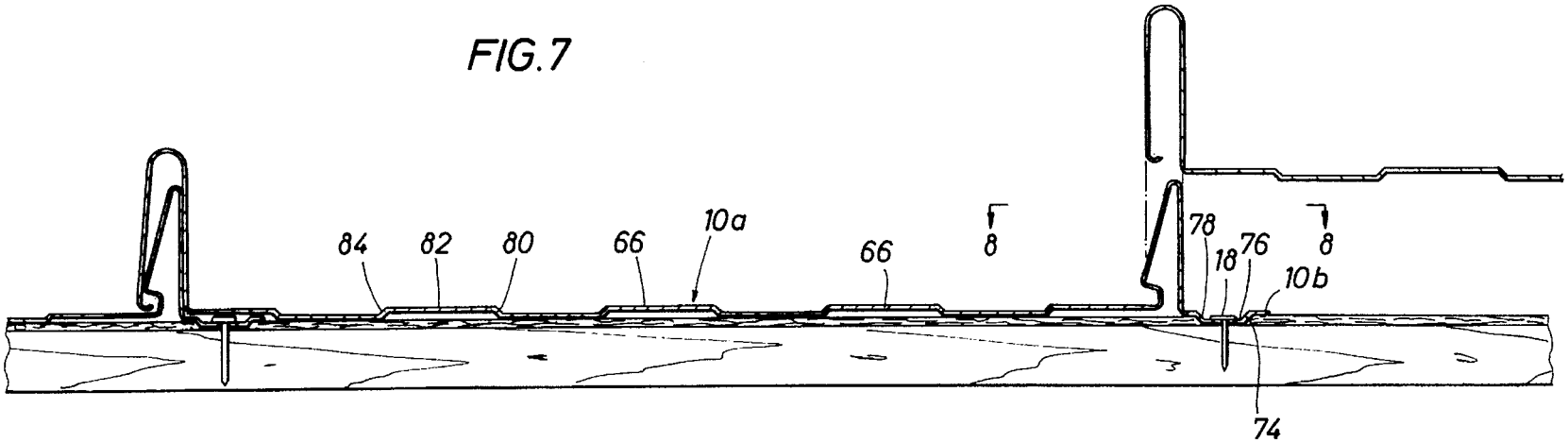
FIG. 7 is a cross-sectional view of an alternate embodiment of the present invention.
Figure 8:
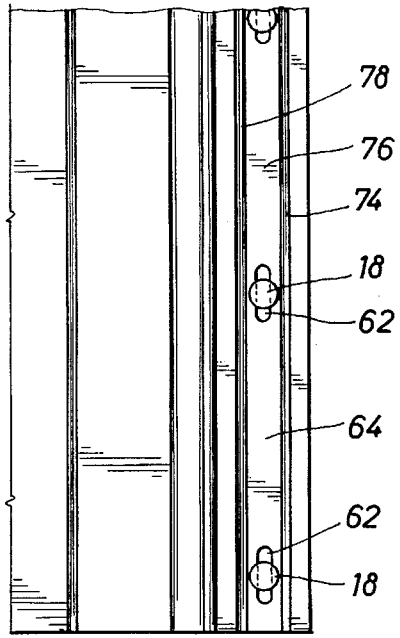
FIG. 8 is a detail view of the smaller dike of the present invention taken along line 8—8 of FIG. 7.

Referring now to FIGS. 7 and 8, an alternate embodiment of the panel and fastening arrangement is shown. Rather than employing a plurality of local recessed sections 60 as shown in FIG. 5, FIGS. 7 and 8 show a single recessed section, or longitudinal channel 64, to receive the fasteners. The channel 64 comprises a descending wall 74, a bottom wall 76, and an ascending wall 78 which generally describe a "U" shape. As shown in FIG. 8, an effective design includes a plurality of slots 62 which guide placement of the fasteners 18.

Whether or not the alternative fastening arrangement discussed above is used, some part of secondary panel portion **10*b* is likely to project somewhat above the plane of the upper surface of the roof board 28. If the panel is comprised of a particularly thin sheet of metal, or the metal is particularly malleable, the problem of "read through" of the fasteners will arise. That is, the head of the fastener will indent the top surface 14 of the primary portion 10*a* of the adjacent panel. If read through isn't expected, then the primary panel portion 10*a*** may comprise a completely flat (i.e., planar) portion of the panel spanning from dike to dike.

If read through is expected, then a fastener dike may be employed. Referring back to FIG. 3, large dike 24 further includes a fastener dike 86 positioned over the secondary panel portion **10*b* of an underlapping adjacent panel. Fastener dike 86 comprises an ascending portion 88 and a top portion 90 which covers the fasteners below. Many users would consider a visually perceptible line generated by the ascending portion 88** to be a pleasant alternative to intermittent read through of the fasteners in the absence of the fastener dike.

Returning to FIG. 7, this panel **10*a* includes one or more structural indentations or ribs, here termed structural dikes 66, to provide additional strength to the panel. Dikes 66 comprise an ascending wall 80, a top wall 82, and a descending wall 84** which generally describe an inverted "U". These dikes serve to significantly increase the panel's ability to carry a load. This capability may be important, for example, whenever the roofing panels are installed directly upon a plurality of roofing boards, rather than a continuous roofing surface or deck.

The foregoing disclosure and description of the invention are illustrative and explanatory only, and various changes in the size, shape, materials, and components, as well as in the details of the illustrated construction and method of operation, may be made without departing from the spirit of the invention.

What is claimed is:

1. A roofing structure of the type comprising a plurality of standing seam roofing panels mounted to a roof deck, each roofing panel of the structure interlockingly joinable with longitudinally adjacent roofing panels of the same type, each of the roofing panels comprising a first and a second longitudinal edge, a first dike extending along the first longitudinal edge and a second dike substantially parallel with and proximate to the second longitudinal edge, and a primary panel portion between the first and second dikes and a secondary panel portion between the second dike and the second longitudinal edge, wherein the improvement comprises:

the first dike includes a first ascending wall connected to the primary panel portion, a first top wall connected to said first ascending wall, and a first descending wall connected to said first top wall, said first ascending and first descending walls are generally parallel to one another and spaced a first distance from one another, the first dike defining a first downwardly opening channel;

the second dike includes a second ascending wall proximate the second longitudinal edge, a second top wall connected to said second ascending wall, and a second descending wall connected to said second top wall and to the primary panel portion, the second dike defining a second downwardly opening channel and wherein the second dike is sized to be received within said first downwardly opening channel of a longitudinally adjacent panel, the second dike has a maximum width from said second ascending wall to said second descending wall slightly greater than said first distance;

said second ascending wall is shorter than said first ascending wall of an overlapping adjacent panel; and said second descending wall defines a concave portion which opens towards the primary panel portion and the first dike has a linking portion extending from the bottom of said first descending wall, wherein following installation of the first dike upon the second dike of an adjacent roofing panel, said linking portion extends into the concave portion defined by the second dike and is sufficiently spaced from the concave portion, defining a lower gap, so that limited upward movement of the first dike relative to the second dike is permitted and at least a portion of said first descending wall frictionally contacts at least a portion of the second descending wall at the maximum width.

2. The roofing structure of claim 1, wherein one or more of the secondary panel portions comprises one or more recessed sections to receive fasteners for securing one or more of said roofing panels to a roof.

3. The roofing structure of claim 2, wherein one or more of said secondary panel portions comprises a plurality of recessed sections, said recessed sections each comprising a slot to receive a fastener.

4. The roofing structure of claim 2, wherein one or more of said secondary panel portions comprises a single recessed channel, said channel comprising a plurality of slots to receive fasteners.

5. The roofing structure of claim 1 wherein one or more of the primary panel portions of said roofing panels further comprises one or more structural dikes.

6. The roofing structure of claim 1, wherein one or more of the first dikes further comprises a fastener dike for positioning over the secondary panel portion of an underlapping adjacent roofing panel.

7. The roofing structure of claim 1, wherein one or more of said linking portions comprises a hook.

8. The roofing structure of claim 1, further comprising a plurality of fasteners for securing each of said roofing panels to a roof.

9. In a combination of adjacent interlocking roofing panels supported by a roof deck, each interlocking roofing panel comprising:

a first and a second longitudinal edge;

a first dike extending along said first longitudinal edge having (i) a first ascending wall, (ii) a first top wall connected to said first ascending wall, (iii) a first descending wall connected to said first top wall proximate to said first longitudinal edge and being generally parallel to said first ascending wall and spaced a first distance from one another, and (iv) a linking portion connected to said first descending wall, said first dike defining a first downwardly opening channel;

a primary panel portion connected to said first dike;

a second dike substantially parallel with and proximate to said second longitudinal edge having (i) a second ascending wall, (ii) a second top wall connected to said second ascending wall, and (iii) a second descending wall connected to said second top wall, said second descending wall connected to said primary panel portion and forming a linking channel near said primary panel portion which opens toward said primary panel portion, said second dike having a maximum width from said second ascending wall to said second descending wall slightly greater than said first distance and adapted to be received within the first downwardly opening channel of an adjacent interlocking roofing panel;

a secondary panel portion between and contacting said second dike and said second longitudinal edge, wherein following installation of said first dike upon the second dike of the adjacent interlocking roofing panel, said linking portion extends into the linking channel and is sufficiently spaced below an upper portion of the linking channel, defining a lower gap, that limited upward movement of said first dike relative to the second dike of the adjacent interlocking roofing panel is permitted and at least a portion of said first descending wall frictionally contacts at least a portion of the second descending wall at the maximum width.

10. The combination of interlocking roofing panels of claim 9, wherein upon installation of said first dike upon the second dike of an adjacent interlocking roofing panel, the second top wall of the second dike is sufficiently spaced below said first top wall of said first dike to define an upper gap therebetween.

11. The combination of interlocking roofing panels of claim 9, wherein said secondary panel portion comprises one or more recessed sections to receive fasteners for securing said roofing panel to a roof.

12. The combination of interlocking roofing panels of claim 11 wherein said secondary panel portion comprises a plurality of recessed sections, said recessed sections each comprising one or more slots to receive a fastener.

13. The combination of interlocking roofing panels of claim 11 wherein said secondary panel portion comprises a single recessed channel, said channel comprising one or more slots to receive fasteners.

14. The combination of interlocking roofing panels of claim 9 wherein said primary panel portion of said roofing panel further comprises one or more structural dikes.

15. The combination of interlocking roofing panels of claim 9 wherein said first dike further comprises a fastener dike for positioning over the secondary panel portion of an underlapping adjacent panel.

16. The combination of interlocking roofing panels of claim 9 wherein said linking portion comprises a hook.

17. The combination of interlocking roofing panels of claim 9 further comprising one or more fasteners for securing said roofing panel to a roof.

18. An interlocking roofing panel coupling for adjacent roofing panels supported by a roof deck comprising:

a first roofing panel comprising:

a first primary panel portion; and a large dike connected to said first primary panel portion, said large dike having a first ascending wall, a first top wall connected to said first ascending wall, and a first descending wall connected to said first top wall, said first ascending and first descending walls are generally parallel to one another and spaced a first distance from one another, said large dike defining a first downwardly opening channel; and a second roofing panel comprising:

a second primary panel portion;

a small dike connected to Said second primary panel portion, said small dike having a second ascending wall, a second top wall connected to said second ascending wall, and a second descending wall connected to said second top wall, said small dike is adapted to be received within the first downwardly opening channel of said large dike, said small dike has a maximum width from said second ascending wall to said second descending wall slightly greater than said first distance; and a secondary panel portion connected to said small dike, said secondary panel portion generally parallel to said primary panel portion, wherein following installation of said large dike upon said small dike at least a portion of said first descending wall frictionally engages at least a portion of said second descending wall at said maximum width.

19. The interlocking roofing panel coupling of claim 18, wherein said second primary panel portion and said secondary panel portion are adapted to bear against the roof deck.

20. The interlocking roofing panel coupling of claim 18, further comprising a linking portion connected to said first descending wall and said second descending wall forming a linking channel near said second primary panel portion which opens toward said second primary panel portion, wherein following installation of said large dike upon said small dike said linking portion extends into said linking channel and is sufficiently spaced below an upper portion of said linking channel, defining a lower gap, that limited upward movement of said large dike relative to said small dike is permitted.

21. The interlocking roofing panel coupling of claim 18, wherein upon installation of said large dike upon said small dike, said second top wall of said small dike is sufficiently spaced below said first top wall of said large dike to define an upper gap therebetween.

* * * * *